US006675622B2

(12) United States Patent
Plicht et al.

(10) Patent No.: US 6,675,622 B2
(45) Date of Patent: Jan. 13, 2004

(54) PROCESS AND ROLL STAND FOR COLD ROLLING OF A METAL STRIP

(75) Inventors: Guido Plicht, Dortmund (DE); Harald Schillak, Bochum (DE); Zbigniew Zurecki, Macungie, PA (US); John Herbert Frey, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 165 days.

(21) Appl. No.: 09/846,619

(22) Filed: May 1, 2001

(65) Prior Publication Data

US 2002/0162374 A1 Nov. 7, 2002

(51) Int. Cl.[7] ..... B21B 27/06
(52) U.S. Cl. ..... 72/201; 72/38; 72/342.2
(58) Field of Search ..... 72/38, 200, 201, 72/202, 342.2, 364, 236

(56) References Cited

U.S. PATENT DOCUMENTS

| | | | | |
|---|---|---|---|---|
| 3,556,174 A | | 1/1971 | Gibbie et al. | 141/69 |
| 4,619,126 A | * | 10/1986 | Kolecki | 72/38 |
| 4,727,747 A | * | 3/1988 | Naud et al. | 72/38 |
| 4,830,683 A | * | 5/1989 | Ferguson | 72/201 |
| 5,616,367 A | | 4/1997 | Spearin et al. | 427/532 |
| 5,653,113 A | | 8/1997 | Sawano | 62/51.1 |
| 5,701,775 A | * | 12/1997 | Sivilotti et al. | 72/201 |
| 5,740,678 A | | 4/1998 | Lee et al. | 62/63 |
| 5,849,098 A | * | 12/1998 | Volkmann | 134/15 |
| 6,406,550 B1 | * | 6/2002 | Feldbauer et al. | 134/2 |

FOREIGN PATENT DOCUMENTS

| | | | | |
|---|---|---|---|---|
| DE | 3150996 | | 3/1983 | B21B/9/00 |
| JP | 55-77925 | * | 6/1980 | 72/257 |
| WO | 9318869 | | 9/1993 | B21B/9/00 |

OTHER PUBLICATIONS

"Cold Rolling Process" C.D. Walzholz, Nov. 4, 1999.

* cited by examiner

*Primary Examiner*—Ed Tolan
(74) *Attorney, Agent, or Firm*—Robert J. Wolff

(57) ABSTRACT

A process is set forth for cold rolling of a metal strip, wherein the metal strip passes through a nip between two counter-rotating rolls, driven in counter-rotation substantially at room temperature, wherein a cold and/or liquefied gas, preferably an inert gas, is blown into the area of the nip or roll gap. A roll stand according to the present invention comprises two counter-rotating rolls forming a nip or rolling gap and nozzle means for blowing a cold and/or liquefied gas, preferably an inert gas, through at least one orifice of said nozzle means into the area of the roll nip. Preferably, the temperature of the cold and/or liquefied gas is appreciably lower than room temperature.

51 Claims, 5 Drawing Sheets

PROCESS AND ROLL STAND FOR COLD ROLLING OF A METAL STRIP

BACKGROUND OF THE INVENTION

Producers of metal strips are using cold roll processes for producing a metal strip with specified mechanical properties, surface properties and thickness. In the cold rolling process, the strip passes through a nip or roll gap existing between two counter-rotating rolls for reducing the thickness of the strip and providing the required surface quality. During the cold roll process a lot of heat is created in the nip due to the friction between the rolls and the strip and due to the deformation of the strip material. This heat has negative influences on the material and surface properties.

In conventional cold rolling processes, liquids, such as oil, water or emulsions, are used as a cooling lubricant for reducing the friction and the heat in the roll gap. Often, these liquids remain on the surface after the cold rolling where they cause negative effects. E.g. water or aqueous emulsions on the surface of the metal strip lead to corrosion, i.e. rust formation. Further, oil residues on the surface have to be removed therefrom as far as possible prior to further processing of the metal strip. Both, the cleaning process and the rejects due to aqueous or oily residues on the surface of the metal strip cause high costs in rework and scrap.

Accordingly, it is an object of the present invention to provide a process and a roll stand for cold rolling of a metal strip, wherein the above-mentioned problems arising from residues on the surface of the metal strip are eliminated to a large extent. According to a second aspect of the present invention a process and a roll stand for cold rolling of a metal strip is to be provided where the deposition of ice or water within the roll stand and/or on the surface of the metal strip to be processed is avoided to a large extent.

BRIEF SUMMARY OF THE INVENTION

According to the present invention there is provided a process for cold rolling of a metal strip, wherein the metal strip passes through a nip between two counter-rotating rolls, driven in counter-rotation substantially at room temperature, wherein a cold and/or liquefied gas, preferably an inert gas, is blown into the area of the nip or roll gap. A roll stand according to the present invention comprises two counter-rotating rolls forming a nip or rolling gap and nozzle means for blowing a cold and/or liquefied gas, preferably an inert gas, through at least one orifice of said nozzle means into the area of the roll nip. Preferably, the temperature of the cold and/or liquefied gas is appreciably lower than room temperature. The term "cold and/or liquefied gas" as used herein relates to a cold fluid in the gaseous or liquid phase or in a phase mixture of gas and liquid.

According to the invention the gas acts and as a cooling agent for cooling the metal strip during the cold rolling process and apparently as a lubricant for reducing friction between the rolls and the metal strip. The cooling effect is stronger if the gas is applied as a liquefied gas due to the larger specific heat of a liquid. According to the invention, the cooling agent, i.e. the gas, vaporizes during and after the cold rolling process without residuals on the surface of the metal strip. Accordingly, the present invention has the advantage that the cooling agent does not have to be removed in a separate process step after the cold rolling process. According to the present invention the gas creates a protective layer between the strip and the rolls. Preferably, the gas is an inert gas thereby avoiding oxidation of the surface of the metal strip.

Due to the better cooling and apparent lubrication effect according to the present invention the metal strip virtually is free of cracks and pores and also the surface quality is better and more uniform. In particular, matte areas that cover the surface of the processed metal strip more or less completely in the conventional cold rolling process using a liquid lubricant are avoided according to the present invention.

The nozzle means according to the invention preferably comprises a plurality of nozzles or orifices for blowing the cold and/or liquefied gas into the region of the nip that are arranged at regular intervals over the width of the metal strip. Preferably, the nozzles or orifices are positioned upstream of the roll nip. The nozzles or orifices may be positioned above and/or below the metal strip. The cold and/or liquefied gas may be blown into the area of the roll nip perpendicular to the metal strip or substantially tangential to the surface of the rolls.

The inventors have observed that two new different types of surface defects occur, when a very cold gas, e.g. liquefied nitrogen gas is used. Namely, oval long matte areas and small matte points have been observed on the surface of the metal strip after the cold rolling process. The inventors have found out that some of these defects can be attributed to the creation of frozen atmospheric water vapor around the nozzles as well as around the feed line to the nozzles and to the water resulting from condensed atmospheric water vapor. Some of the defects observed could also be attributed to drops of liquefied gas, e.g. of liquefied nitrogen gas, falling onto the surface of the metal strip to be processed.

In order to avoid these problems, the process for cold rolling of a metal strip according to the present invention may further comprise a step of shrouding or shielding the nozzle means at least near the orifice of the nozzle means from the ambient atmosphere for preventing the creation of water or ice near the orifice of the nozzle means due to frozen or condensed atmospheric water vapor. Accordingly, the creation of matte areas on the surface of the metal strip can be avoided.

According to a first embodiment of the present invention the jets of cold and/or liquefied gas and/or the orifices of the nozzle system are shrouded or shielded by a flow a dry gas around the jet and/or the orifices during the cold rolling process. Thus, it can be avoided that water vapor from the ambient atmosphere enters the cooled region, e.g. the roll nip with the metal strip there between and/or the orifices of the nozzle system. Thus, the condensation or crystallization of the water vapor is eliminated.

In principle any pure gas, i.e. not containing agents that could condense or crystallize to thereby cause the above-mentioned matte areas or surface defects, can be used according to the present invention. Preferably, the dry gas should be an inert gas. The process and roll stand according to the present invention may be simplified further, if the flow of dry gas is branched off from the flow of cold and/or liquefied gas, which flows to the orifices of the nozzle means and is used for cooling.

The dry gas may be applied as a curtain of dry gas surrounding the jets of cold and/or liquefied gas emitted from the orifices of the nozzle means. Preferably, this curtain of dry gas shrouds the entire area both of the orifices of the nozzle means and of the roll nip including the metal strip being cooled by the cold and/or liquefied gas.

Preferably, each feed line of an orifice for supplying the orifice of the nozzle system with the cold and/or liquefied gas is surrounded by a tube or a box-shaped structure through which the dry gas is blown towards the metal strip. Thus, the flow of dry gas is guided to flow substantially in parallel to the jet of cold and/or liquefied gas. Thus, it can be avoided that condensed water vapor or ice crystals from the ambient atmosphere fall onto the surface of the metal strip, where they would cause defects. A further advantage is that the amount of dry gas required for shrouding the orifices and/or jets of gas may be reduced substantially. A further advantage is that due to the steady flow of dry gas around the orifices of the nozzle system any deposition of ice or water on the orifices can be prevented completely.

Preferably, the jets of cold and/or liquefied gas are emitted from the orifices of the nozzle means in the shape of a cone with the center in the middle of the respective orifice. Thus, a uniform distribution of gas in the area of the roll nip can be ensured. For a better shrouding the orifice may be located within the tube or box-shaped structure at a distance to the front face of the tube or box-shaped structure so that the cone does not intersect the tube or box-shaped structure on its way towards the metal strip.

If the liquefied gas is fed to the orifices of the nozzle means, a part of the liquefied gas normally vaporizes. The gas bubbles thus created in the feed line causes pressure differences at the orifices or nozzle outlets and thus a pulsation of the gas jet emitted and of the liquefied gas supply. This pulsation is even amplified further within the feed line, because the gas of the bubbles has a smaller specific heat resulting in a less efficient cooling at certain regions within the feed line for liquefied gas. The pulsation of gas causes a non-uniform cooling effect in the area of the roll nip and may also dislodge ice crystals near the orifices or the nozzle means. Furthermore, the pulsation of gas in the feed line might also cause mechanical vibrations of the feed line that might also dislodge ice crystals near the orifices or the nozzle means or on the surface of the feed line. The inventors have observed, that these pulsation contribute to long oval matte areas on the surface of a metal strip.

For the purpose of eliminating these problems, the dry gas flowing through the tube or box-shaped structure surrounding every feed line of the nozzle means is preferably derived directly from the flow of cold and/or liquefied gas for cooling. Thus, the exterior of the feed line and the orifices of the nozzle means can be cooled efficiently thereby reducing the above-mentioned two-phase flow of gas in the feed line.

Preferably, the flow of gas through the tube or box-shaped structure is regulated by a control valve in order to obtain a constant cooling rate and a constant shrouding effect. Preferably this control valve is used simultaneously as a throttling means for expanding the cold and/or liquefied gas to thereby reduce its temperature.

Thus, the temperature of the gas flowing through the tube or box-shaped structure may be lowered below the temperature of the gas in the feed line to thereby further eliminate the above-mentioned two-phase flow. Thus sub-cooling of the feed line can be achieved in an efficient manner.

In order to further avoid the condensation or crystallization of water vapor from the ambient atmosphere heat exchange means or other heating means may be provided, preferably at the front end of the nozzle means. The heat exchange means may surround the tube or box-shaped structure, preferably only at a front portion. The fluid may flow through the heat exchange means.

According to a second embodiment of the present invention a shrouding at least near the orifices of the nozzle means from ambient atmosphere is provided by a suitable mechanical structure for preventing the creation of condensed water or ice stemming from atmospheric water vapor near the orifices or nozzle outlets.

According to this second embodiment shrouding may be provided by any mechanical structure sufficiently shielding the orifices or the nozzle means and/or the feed lines from ambient atmosphere. Such a shrouding may be provided by a single box surrounding all orifices or nozzle outlets and at least a portion of their respective feed lines for supplying cold and/or liquefied gas. Preferably, such a box has a front cover with openings aligned with the respective orifices to allow the flow of cold and/or liquefied gas towards the metal strip. Instead of a single box also a plurality of boxes may be provided, each for a respective orifice of the nozzle means. As an alternative, a tube may surround each orifice or nozzle outlet and at least a portion of the associated feed line. Thus, the orifices can be shrouded in a simple and cost efficient manner.

The second embodiment of the present invention may be preferred, if a cold and/or liquefied gas at a moderate temperature as compared to room temperature is used for cooling, because at moderate temperatures the condensation and crystallization of atmospheric water vapor is used. An example of a liquefied gas used according to this second embodiment is carbon dioxide gas. This may be sufficient, e.g. for roll stands not used in continuous operation or with a relatively low throughput.

Hereinafter, specific examples of preferred embodiments according to the present invention will be described. When read with reference to the Figures, further advantages, features and objects of the present invention will become aware to the skilled artisian.

BRIEF DESCRIPTION OF SEVERAL VIEWS OF THE DRAWINGS

In the Figures, like reference numerals relate to identical or equivalent means or elements.

DETAILED DESCRIPTION OF THE INVENTION

Figure 1:
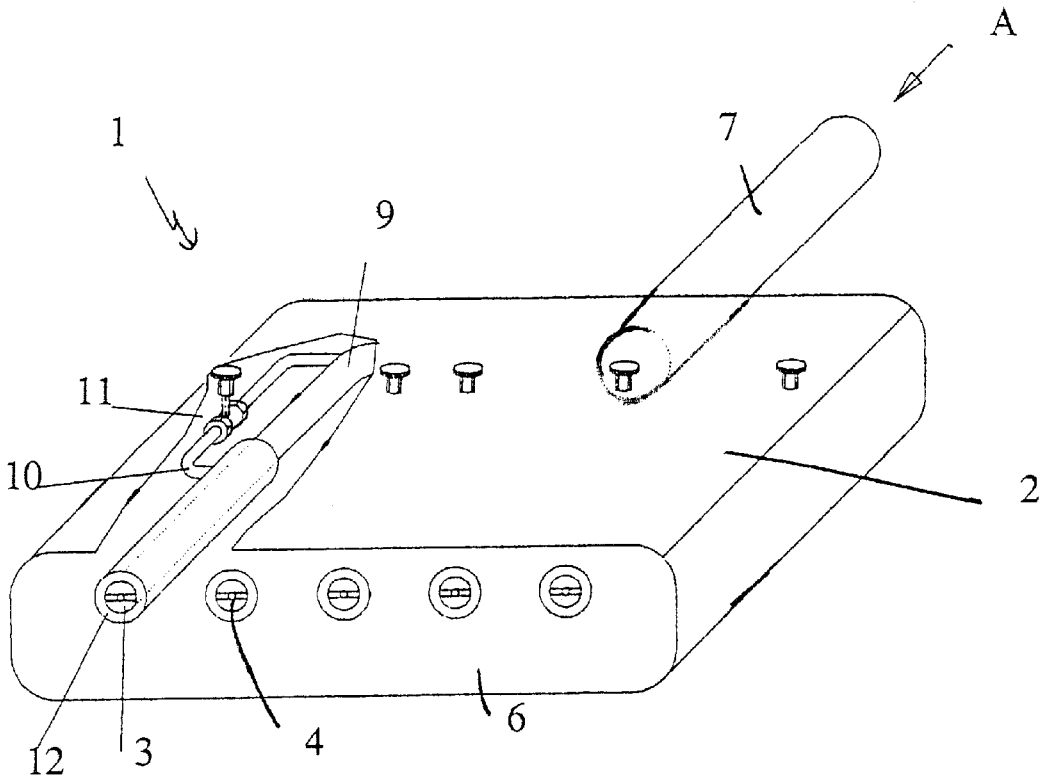
FIG. 1 is a perspective view of a nozzle means according to a first embodiment of the present invention with partial section.
Figure 6:
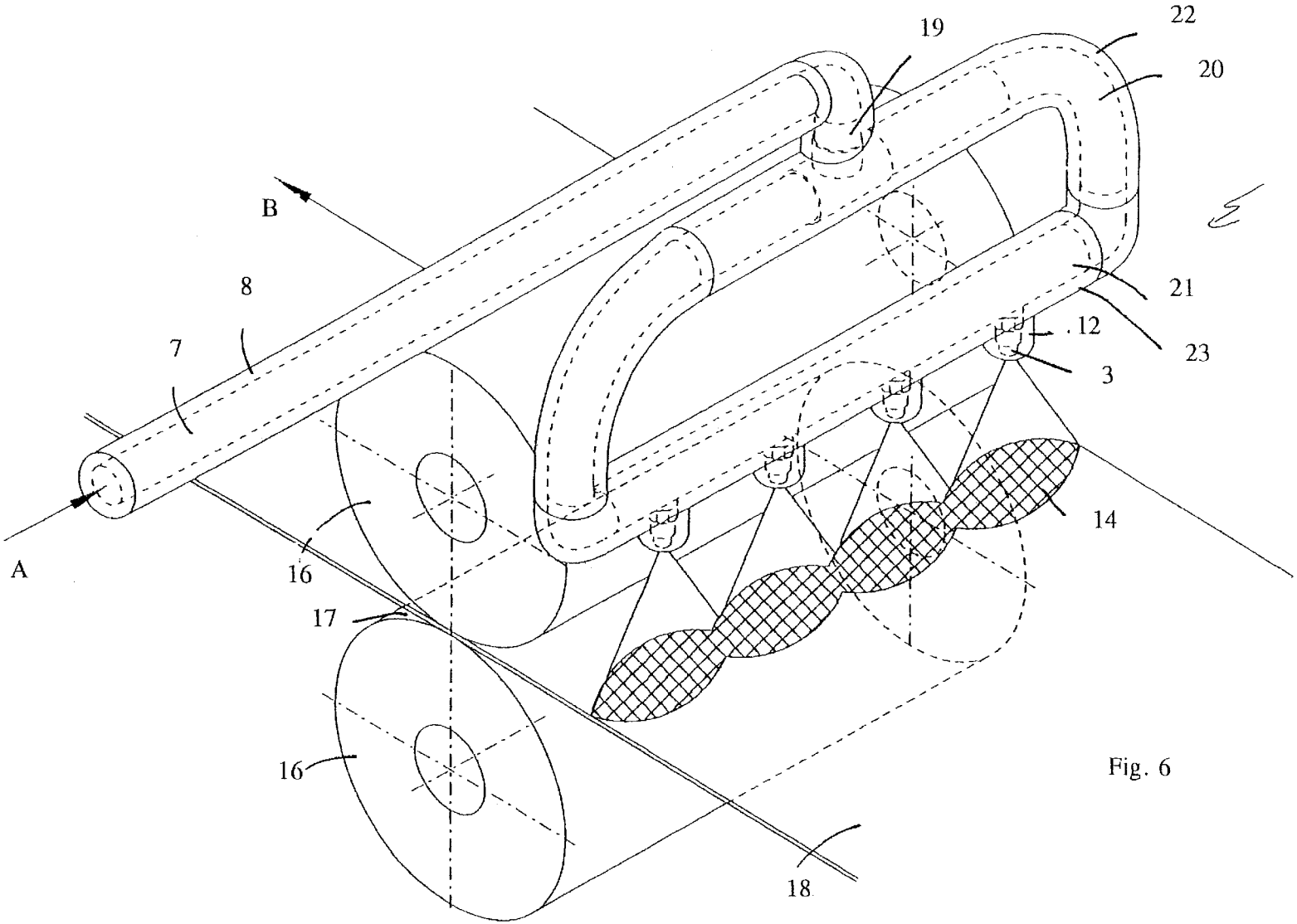
FIG. 6 shows a roll stand in perspective view including a nozzle means according to the second embodiment of the present application.

FIG. 1 shows in perspective view a nozzle means 1 according to a first embodiment of the present invention. The nozzle means 1 comprises five nozzles 3 including a circular orifice 4 in the middle. A cone-shaped extension may be provided at the front part of each nozzle for guiding the flow of cold and/or liquefied gas emitted from the nozzles into a cone-shaped jet of cold and/or liquefied gas, as schematically shown in FIG. 6 (reference numeral 14). The nozzles 3 communicate via feed lines 9 with an insulated main feed line 7. The nozzles 3 and the feed lines 9 are housed in the box 2. A heat insulator may be provided within the box 2, e.g. a resin or a foam of plastics like PU foam. The box 2 comprises a front cover 6 with circular openings respectively aligned with an orifice 4 or nozzle 3 so that the jets of cold and/or liquefied gas can propagate without hindrance towards the metal sheet or strip.

In operation of the nozzle means, the main feed line 7 is supplied with cold and/or liquefied gas (arrow A). Examples for the gas include but are not limited to nitrogen, noble gas and carbon dioxide. Preferably the gas is an inert gas to thereby avoid oxidation of the metal strip. The gas may be fed via the main line 7 as a liquefied gas, a gas or a mixture of liquefied gas and gas.

As can be seen in the partial section in the left hand part of FIG. 1, each nozzle 3 and at least the front part of each feed line 9 is surrounded by a shroud tube 12 for shrouding or shielding the area near the orifice of the nozzle 3. The interior of the shroud tube 12 communicates with the respective feed line 9 via feed line 10 respectively provided with a control valve 11. The control valve 11 is used to control the flow of cold and/or liquefied gas through the shroud tube 12.

As an alternative (not shown) each shroud tube 12 may communicate via a feed line and a control valve with a source of dry gas so that a different type of gas may be used for shrouding the jet of cold and/or liquefied gas emitted from the nozzles 3.

The outer surface of feed line 9 and the inner surface of shroud tube 12 may be provided with a reflective cooling.

In operation, a jet of gas, e.g. a cone-shaped jet, is emitted from each nozzle 3. The jet is surrounded by a curtain of dry gas emitted from the shroud tube 12. Thus, ambient water vapor cannot condense or crystallize in or near the jet of gas used for cooling the metal strip. The dry gas leaves the shroud tube 12 substantially in parallel with the respective jet of gas used for cooling. The flow rate through the shroud tube 12 may be substantially lower than the flow rate of gas through the feed line 9 and nozzle 3 so that the shape of the gas jet emitted from each nozzle 3 is not disturbed by the dry gas.

Figure 2:
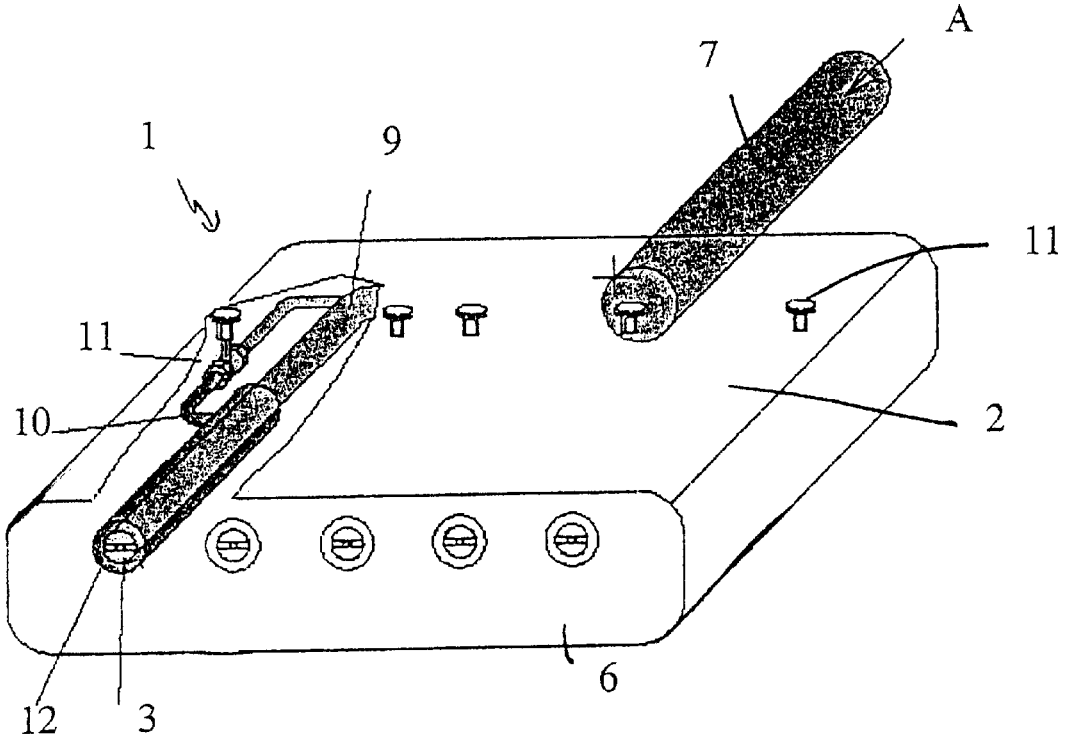
FIG. 2 shows the perspective view of FIG. 1 with feed lines and shrouding lines highlighted.

As can be seen in the partial section in the left hand part of FIG. 2, the control valve 11 may act simultaneously as a throttling valve where the gas flowing through the control valve 11 expands. Due to the gas expansion the temperature of the gas within the shroud tube 12 is lower than the temperature of the gas in the feed line 9. Thus, both the nozzle 3 near its orifice 4 and the feed line 9 at its front portion, which is surrounded by the shroud tube 12, are cooled, thereby preventing or substantially reducing two-phase flow of gas in the feed line 9. Thus, any pulsation of the gas used for cooling within the feed line 9 can be prevented or substantially reduced. This results in a more uniform distribution of the gas on the metal strip.

Figure 3:
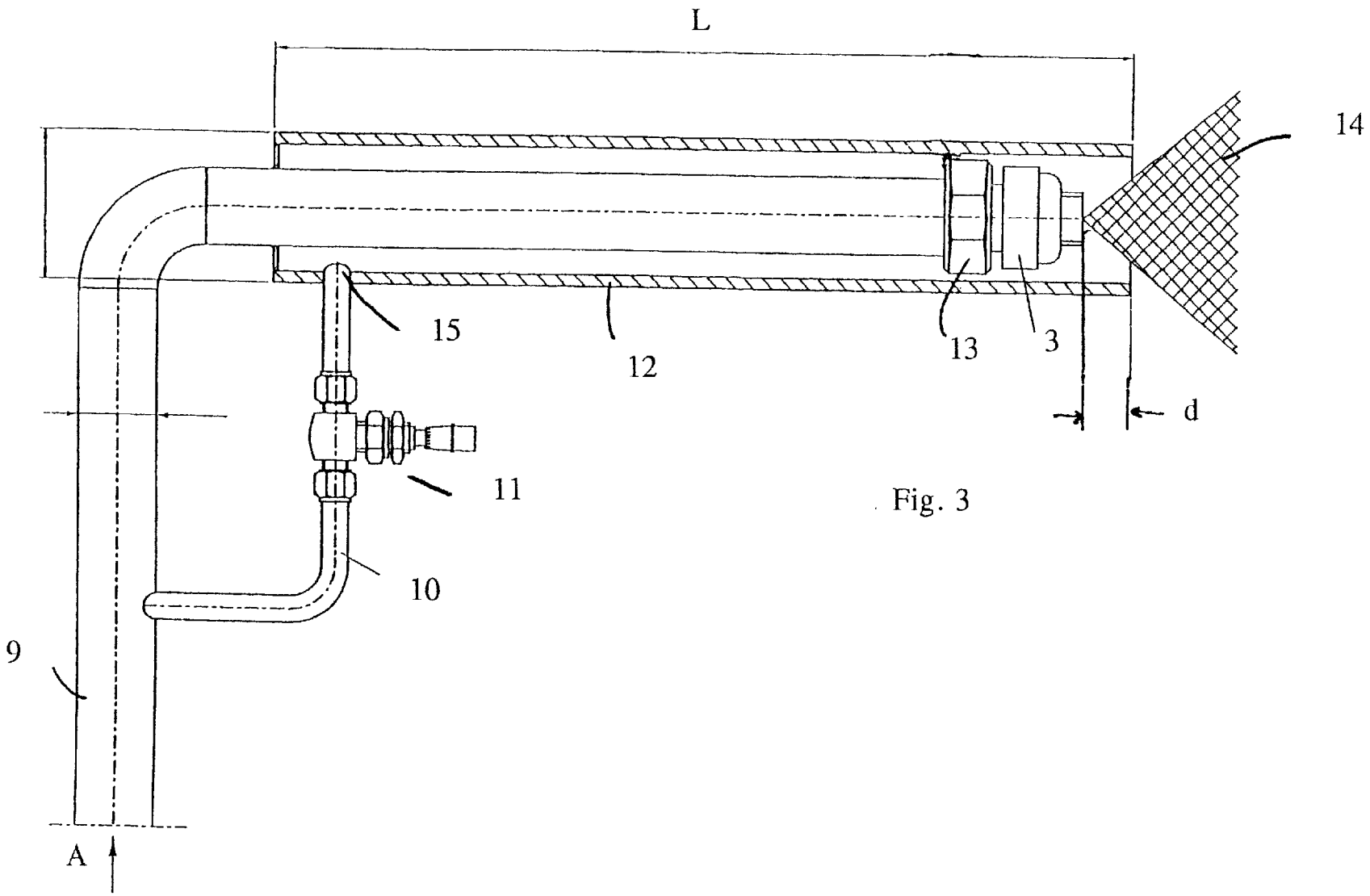
FIG. 3 is a sectional view showing a nozzle and a shroud tube.

FIG. 3 shows a sectional view of the front portion of the feed line 9 including a shroud tube 12 for shrouding the region near the orifice of the nozzle 3. FIG. 3 shows the feed line 9 of the left most or right most nozzle 3 of the embodiment according to FIGS. 1 and 2. The shroud tube projects from the front face of the nozzle 3 by a distance d. The distance d is chosen in accordance with the opening angle of the cone-shaped jet 14 emitted from the nozzle 3 so that the gas does not impinge on the interior surface of the shroud tube 12.

The nozzle 3 is connected by a suitable connecting means 13 with the feed line 9. The interior of the shroud tube 12 communicates via the orifice 15, the control valve 11, and the feed line 10 with the feed line 9 so that a part of the gas in the feed line 9 is branched off towards the shroud tube 12.

The length L of the shroud tube 12 is chosen in accordance with the extent of cooling and reducing two-phase flow of gas in the feed line 9.

The nozzle 3 may provide a hollow cone, a solid cone or a flat cone of gas. Preferably, a flat cone is used. The opening angle of the cone 14 emitted from the nozzle 3 may be in the range between 45° to 110°, preferably near 80°. The diameter of the feed line 9 may be in the range between 10 and 20 mm, preferably 15 mm. The inner diameter of the shroud tube may be in the range between 20 and 55 mm, preferably 35 mm. The distance d may be in the range between +10 mm and −10 mm (+projecting/−retracted position), preferably −5 mm. Liquefied nitrogen may be supplied at a pressure between 0.5 atm to 16 atm, preferably 6 atm. The flow rate of liquefied nitrogen through each nozzle may be in the range between 10 l/h to 300 l/h, preferably 100 l/h to 150 l/h, with a flow rate through the shroud tube 12, preferably in the range between 10 to 30 l/h. The skilled person may easily become aware of different parameter ranges depending on the specifications of the roll stand to be provided.

Figure 4:
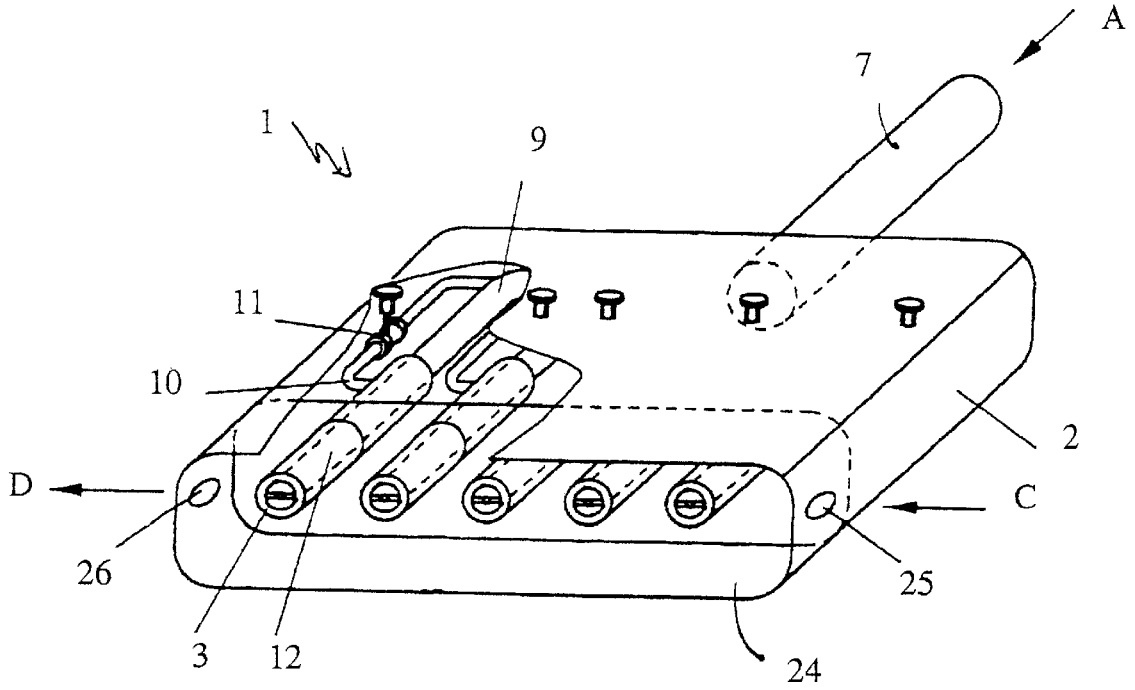
FIG. 4 is a perspective view of a nozzle means according to the first embodiment of this invention including a heat exchanger at a front part thereof.

FIG. 4 shows a modification of the first embodiment according to the present invention. In this modification a heat exchanger 24 is provided at the front part of the nozzle means 1 for controlling the temperature so that neither ice is deposited nor water condenses from atmospheric water vapor at the front part. For this purpose, the front part of the box 2 is formed as separate chamber 24 with an inlet port 25 and an outlet port 26 so that a fluid for heat exchange may flow through the chamber 24 around the shroud tubes 12. If no shroud tubes are provided, as it is the case in the second embodiment of the present invention, the fluid may directly flow around the feed lines 9 instead. The flow rate of the fluid C entering the heat exchanger 24 or the flow rate of fluid D leaving the heat exchanger 24 may be controlled, e.g. by a control valve, so that a stable temperature can be obtained at the front part of the nozzle means 1. Suitably, a temperature well above the dew point of ambient water vapor is chosen.

Figure 5:
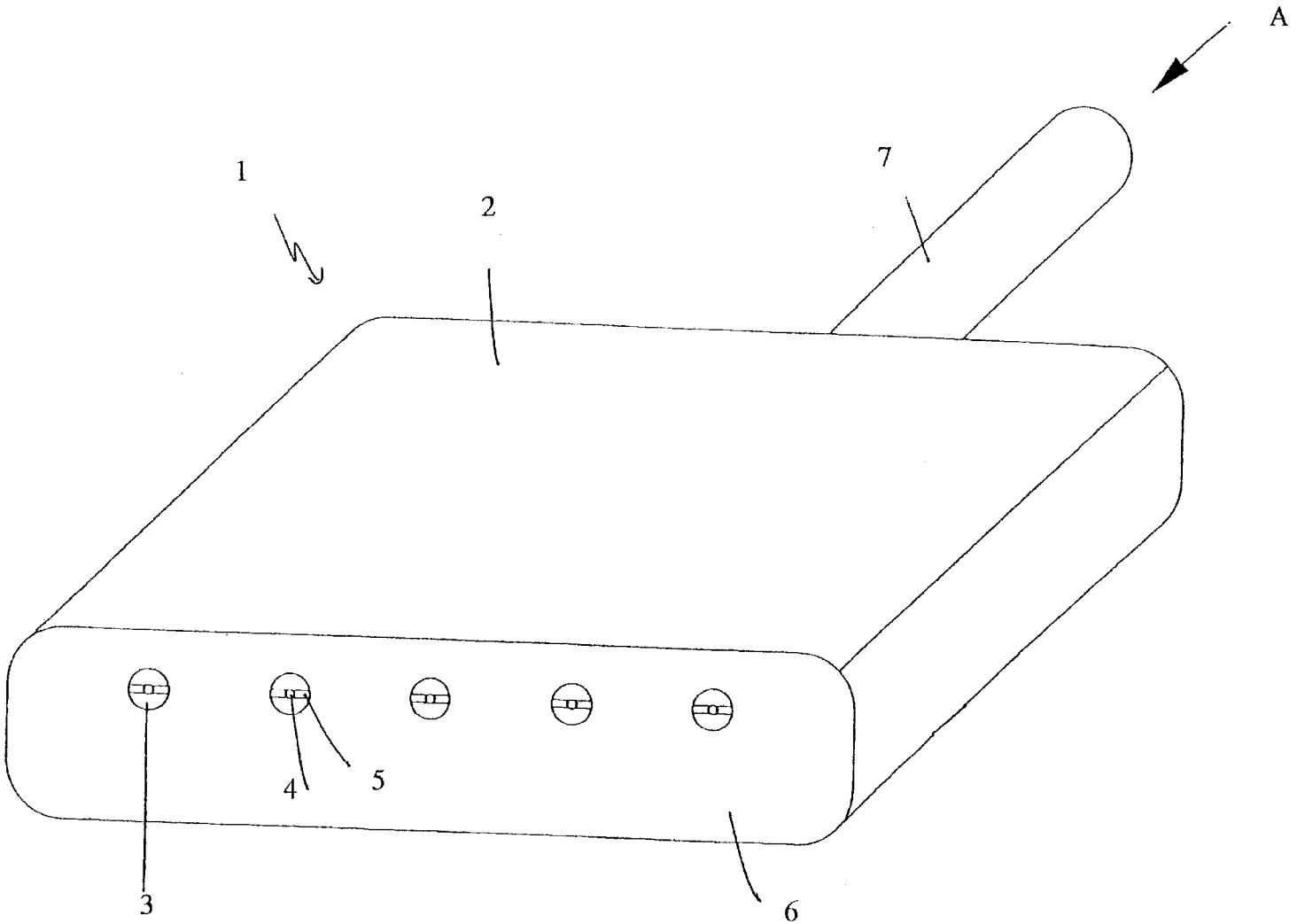
FIG. 5 is a perspective view of a second embodiment of a nozzle means according to the present invention.

FIG. 5 shows a second embodiment of the nozzle means 1 according to the present invention. According to the second embodiment no curtain of dry gas is provided for shrouding the orifices 4 and/or the jet of gas used for cooling. Instead, according to the second embodiment, the plurality of nozzles 3 and at least the front portion of the associated feed line 9 is housed in a box 2 including a front cover 6 with a plurality of openings in alignment with the respective nozzle 3. Instead of providing a box-shaped structure 2 a skilled person in this field may easily become aware of other suitable shrouding structures. The relatively small cross-sectional area of the openings in the front cover 6 ensures that virtually no ambient air or ambient water vapor can enter the interior of the box 2. In particular, this is the case when gas continuously flows out of the nozzles 3, because the jet of gas results in a roller-shaped flow of ambient air away from the front cover 6 of the box 2.

In order to prevent a condensation or crystallization of water vapor within the box 2 or near the orifices 4, the following measures may be taken: a hygroscopic agent may be provided within the box 2; the interior of the box 2 may be filled completely with a heat insulating material, e.g. a plastic foam like PU foam; a heating means may be provided at the front portion of the nozzle means 1, e.g. on the inner surface of the front cover 6, to heat this region to a temperature above the dew point; a heat exchanger, comparable to the heat exchanger 24 according to FIG. 4, may be provided.

FIG. 6 shows a modification of the second embodiment according to the present invention. As shown in FIG. 6, four nozzles 3 are arranged side by side, directly communicating with a lower transverse feed line 21 that is symmetrically fed by the main feed line 7. Heat insulation tubes 8, 22, 23, and 12 surrounding the feed lines are provided. The front end of each tube 12 comprises an opening in alignment with the orifice of the respective nozzle 3.

FIG. 6 schematically also shows a roll stand including a nozzle means 1 according to the second embodiment. Two counter-rotating rolls 16, at least one of them being driven, are provided for cold rolling the metal strip 18 fed into the direction B. In the roll nip 17 the metal strip or sheet 18 is reduced in thickness.

In order to cool the metal strip 18 in the area of the nip portion and to simultaneously reduce the friction between the rolls 16 and the metal strip 18, cool and/or liquefied gas, preferably liquefied gas, is blown into the nip region 17 by the nozzle means 1. The nozzle means 1 may be provided on one or both sides of the rolls 16. Furthermore, the nozzle means 1 may be provided above the metal strip 18, as shown, and/or below the metal strip 18. The gas may be blown into the nip region 17 in a direction substantially perpendicular to the metal strip 18 or in any other suitable direction, e.g. substantially tangential to the rolls 16. Suitable choice of the nozzles 3 and the distances between the nozzles 3 ensures a uniform distribution of the gas used for cooling.

While specific examples have been shown above, various modifications can be performed without leaving the scope of this invention, as will become apparent to a skilled person.

What is claimed is:

1. A process for cold rolling of a metal strip comprising passing said metal strip through a nip between two counter-rotating rolls;

blowing a cold and/or liquefied gas, preferably an inert gas, through at least one orifice of a nozzle means into an area of said roll nip; and shrouding said nozzle means at least near said orifice of said nozzle means from ambient atmosphere for preventing the creation of water or ice near said orifice.

2. A process as claimed in claim 1, the step of shrouding comprising providing a flow of dry gas flowing around an exterior of said orifice of said nozzle means.

3. A process as claimed in claim 2, further comprising branching off said flow of dry gas from a flow of said cold and/or liquefied gas flowing to said orifice of said nozzle means.

4. A process as claimed in claim 3, further comprising regulating said flow of dry gas by means of valve means.

5. A process as claimed in claim 4, further comprising expanding said dry gas flowing through said valve means for reducing the temperature of said dry gas for cooling the exterior of said orifice of said nozzle means.

6. A process as claimed in claim 2, further comprising surrounding a feed line for feeding said cold and/or liquefied gas to said orifice by means of a tube, said dry gas flowing in said tube around said feed line towards said nozzle orifice.

7. A process as claimed in claim 6, said step of surrounding said feed line comprising arranging said nozzle orifice spaced apart from a front face of said tube, said flow of cold and/or liquefied gas emitting from said orifice without impinging on an interior of said tube.

8. A process as claimed in claim 6, further comprising providing a box surrounding said tube for isolating said tube and said orifice from ambient atmosphere.

9. A process as claimed in claim 8, further comprising filling an interior of said box with a heat insulating material.

10. A process as claimed in claim 6, further comprising providing heat exchange means for exchanging heat between said tube and a fluid flowing through said heat exchange means for preventing deposition of water or ice on at least one of said tube and said orifice.

11. A process as claimed in claim 1, said cold and/or liquefied gas being fed as a liquid at a temperature below its liquefaction temperature.

12. A process as claimed in claim 1, said cold and/or liquefied gas being selected from a group consisting of nitrogen and carbon dioxide.

13. A process as claimed in claim 1, said cold and/or liquefied gas being a noble gas.

14. A process as claimed in claim 1, a material of said metal strip being selected from a group consisting of steel, aluminum, copper and brass.

15. Process for cold rolling of a metal strip comprising passing said metal strip through a nip between two counter-rotating rolls;

blowing a cold and/or liquefied gas, preferably an inert gas, through at least one orifice of a nozzle means into an area of said roll nip; and providing a shrouding for shrouding said nozzle means at least near said orifice of said nozzle means from ambient atmosphere for preventing the creation of water or ice near said orifice.

16. A process as claimed in claim 15, said step of shrouding comprising providing a box including a front cover for partially surrounding said at least one orifice, said front cover being provided with at least one opening, each opening being aligned with an orifice.

17. A process as claimed in claim 16, further comprising filling an interior of said box with a heat insulating material.

18. A process as claimed in claim 16, further comprising providing at least one of said box and said front cover with a reflective coating at a surface facing said orifice.

19. A process as claimed in claim 16, further comprising heating at least one of said box and said front cover for preventing deposition of water or ice.

20. A process as claimed in claim 16, further comprising providing heat exchange means for heat exchange between said orifice and at least one of said box and said front cover for preventing deposition of water or ice.

21. A process as claimed in claim 15, said step of shrouding comprising providing at least one tube, each tube surrounding a feed line for supplying an orifice of said nozzle means with said cold and/or liquefied gas at least near said orifice.

22. A process as claimed in claim 21, said step of providing said tube comprising arranging said orifice spaced apart from a front face of said tube, said flow of cold and/or liquefied gas emitting from said orifice without impinging on an interior of said tube.

23. A process as claimed in claim 21, further comprising providing a surface of said tube facing to said feed line with a reflective coating.

24. A process as claimed in claim 15, said cold and/or liquefied gas being fed as a liquid at a temperature below its liquefaction temperature.

25. A process as claimed in claim 15, said cold and/or liquefied gas being selected from a group consisting of nitrogen and carbon dioxide.

26. A process as claimed in claim 15, said cold and/or liquefied gas being a noble gas.

27. A process as claimed in claim 15, a material of said metal strip being selected from a group consisting of steel, aluminum, copper and brass.

28. A roll stand for cold rolling of a metal strip comprising two counter-rotating rolls forming a nip for the passage of said metal strip and nozzle means comprising at least one orifice for blowing a cold and/or liquefied gas, preferably an inert gas into an area of said roll nip, shrouding means being provided for shrouding said nozzle means at least near said orifice from ambient atmosphere for preventing a creation of water or ice near said orifice.

29. A roll stand as claimed in claim 28, wherein said shrouding means comprises at least one tube, each tube respectively surrounding a feed line supplying an orifice with said cold and/or liquefied gas, each tube being connected with a source of dry gas, preferably inert gas.

30. A roll stand as claimed in claim 29, wherein each tube communicates with a main feed line supplying said nozzle means with said cold and/or liquefied gas.

31. A roll stand as claimed in claim 30, a valve means being provided for each tube for controlling a flow of said dry gas through said tube.

32. A roll stand as claimed in claim 31, said valve means acting as a throttling means, said dry gas expanding while flowing through said valve means whereby a temperature of said dry gas is reduced for cooling said feed line of said orifice.

33. A roll stand as claimed in claim 29, wherein each orifice of said nozzle means is arranged spaced apart from a front face of said tube, said flow of cold and/or liquefied gas emitting from said orifice without impinging on an interior of said tube.

34. A roll stand as claimed in claim 29, further comprising a box surrounding said tube for isolating said tube and said orifice.

35. A roll stand as claimed in claim 34, an interior of said box being filled with a heat insulating material.

36. A roll stand as claimed in claim 34, further comprising heat exchange means for heat exchange for controlling a temperature of said tube to prevent the deposition of water or ice on at least one of said tube and said orifice.

37. A roll stand as claimed in claim 36, said heat exchange means comprising an inlet and outlet port for supplying said heat exchange means with a heat exchange fluid.

38. A roll stand as claimed in claim 29, said nozzle means comprising a plurality of orifices each communicating with a main feed line for cold and/or liquefied gas via a respective feed line, said plurality of feed lines being supplied with said cold and/or liquefied gas symmetrically.

39. A roll stand as claimed in claim 28, said nozzle means applying liquefied inert gas on a surface of said metal strip.

40. A roll stand as claimed in claim 28, said nozzle means applying liquefied nitrogen gas or noble gas or carbon dioxide on a surface of said metal strip.

41. A roll stand for cold rolling of a metal strip comprising two counter-rotating rolls forming a nip for the passage of said metal strip and nozzle means comprising at least one orifice for blowing a cold and/or liquefied gas, preferably an inert gas, into an area of said roll nip, wherein shrouding means are provided at least partially surrounding said at least one orifice of said nozzle means from ambient atmosphere for preventing a creation of water or ice near said orifice.

42. A roll stand as claimed in claim 41, said shrouding means comprising a box including a front cover for partially surrounding said at least one orifice, said front cover being provided with at least one opening, each opening being aligned with a respective orifice.

43. A roll stand as claimed in claim 42, an interior of said box being filled with a heat insulating material.

44. A roll stand as claimed in claim 42, a surface of at least one of said box and said front cover being provided with a reflective coating, said surface facing said orifice.

45. A roll stand as claimed in claim 41, further comprising heating means for heating at least one of said box and said front cover for preventing a deposition of water or ice near said orifice.

46. A roll stand as claimed in claim 41, further comprising heat exchange means for heat exchange between said orifice and at least one of said box and said front cover for preventing deposition of water or ice near said orifice.

47. A roll stand as claimed in claim 41, said shrouding means comprising at least one tube, each tube surrounding a feed line for supplying an orifice of said nozzle means with said cold and/or liquefied gas at least near said orifice.

48. A roll stand as claimed in claim 47, wherein said orifice is arranged in said tube spaced apart from a front face of said tube so that said flow of cold and/or liquefied gas emits from said orifice without impinging on an interior of said tube.

49. A roll stand as claimed in claim 47, a surface of said tube facing to said feed line being provided with a reflective coating.

50. A roll stand as claimed in claim 41, said nozzle means applying liquefied inert gas on a surface of said metal strip.

51. A roll stand as claimed in claim 41, said nozzle means applying liquefied nitrogen gas or noble gas or carbon dioxide on a surface of said metal strip.

* * * * *